US008800161B2

(12) United States Patent
Anibas

(10) Patent No.: US 8,800,161 B2
(45) Date of Patent: Aug. 12, 2014

(54) DRYER FOR MATERIAL TO BE DRIED

(75) Inventor: Franz Anibas, Gleisdorf (AT)

(73) Assignee: Binder + Co AG (AT)

( * ) Notice: Subject to any disclaimer, the term of this patent is extended or adjusted under 35 U.S.C. 154(b) by 846 days.

(21) Appl. No.: 12/933,247

(22) PCT Filed: Mar. 19, 2009

(86) PCT No.: PCT/EP2009/053228
§ 371 (c)(1),
(2), (4) Date: Oct. 21, 2010

(87) PCT Pub. No.: WO2009/115564
PCT Pub. Date: Sep. 24, 2009

(65) Prior Publication Data

US 2011/0035955 A1 Feb. 17, 2011

(30) Foreign Application Priority Data

Mar. 19, 2008 (AT) ..... GM169/2008 U

(51) Int. Cl.
*F26B 3/00* (2006.01)

(52) U.S. Cl.
USPC ..... 34/218; 34/236; 34/242; 209/344; 209/366; 266/249; 266/259; 210/640; 518/700

(58) Field of Classification Search
USPC ..... 34/369, 580, 201, 210, 218, 236, 242; 209/319, 344, 366, 312, 321; 266/249, 266/259; 210/640; 518/700
See application file for complete search history.

(56) References Cited

U.S. PATENT DOCUMENTS 2,163,556 A 6/1939 Glaze
3,161,483 A * 12/1964 Morris ..... 34/580
(Continued)

FOREIGN PATENT DOCUMENTS

AT 384 349 B 4/1987
DE 22 36 613 A1 2/1973
(Continued)

OTHER PUBLICATIONS

International Search Report for PCT/EP2009/053228, Dated Jul. 24, 2009, 6 Page.

*Primary Examiner* — Steve M Gravini
(74) *Attorney, Agent, or Firm* — McKee, Voorhees & Sease

(57) ABSTRACT

A dryer for material to be dried (T), wherein an air supply channel (4) for supplying a drying gas to the drying region is provided, and at least one exhaust-gas opening (8) is provided for removing the drying gas, wherein the air supply channel (4) is surrounded at a distance by an outer wall (11), which has at least one supply opening (12) and at least one removal opening (13) for the cooling medium (K), wherein between the at least one supply opening (12) and the at least one removal opening (13) a flow section (14) for the cooling medium (K) is formed between the outer wall (11) and the air supply channel (4). According to the invention, the at least one removal opening (13) is configured as a through-opening in the air supply channel (4), which connects the region bounded by the outer wall (11) to the interior of the air supply channel (4), wherein the at least one through-opening (13) is arranged in the upper regions of the air supply channel (4) and is configured in such a way as to make it possible for the cooling medium (K) to flow downwards along the inner side of the air supply channel (4).

7 Claims, 5 Drawing Sheets

(56) References Cited

U.S. PATENT DOCUMENTS

Figure 1:
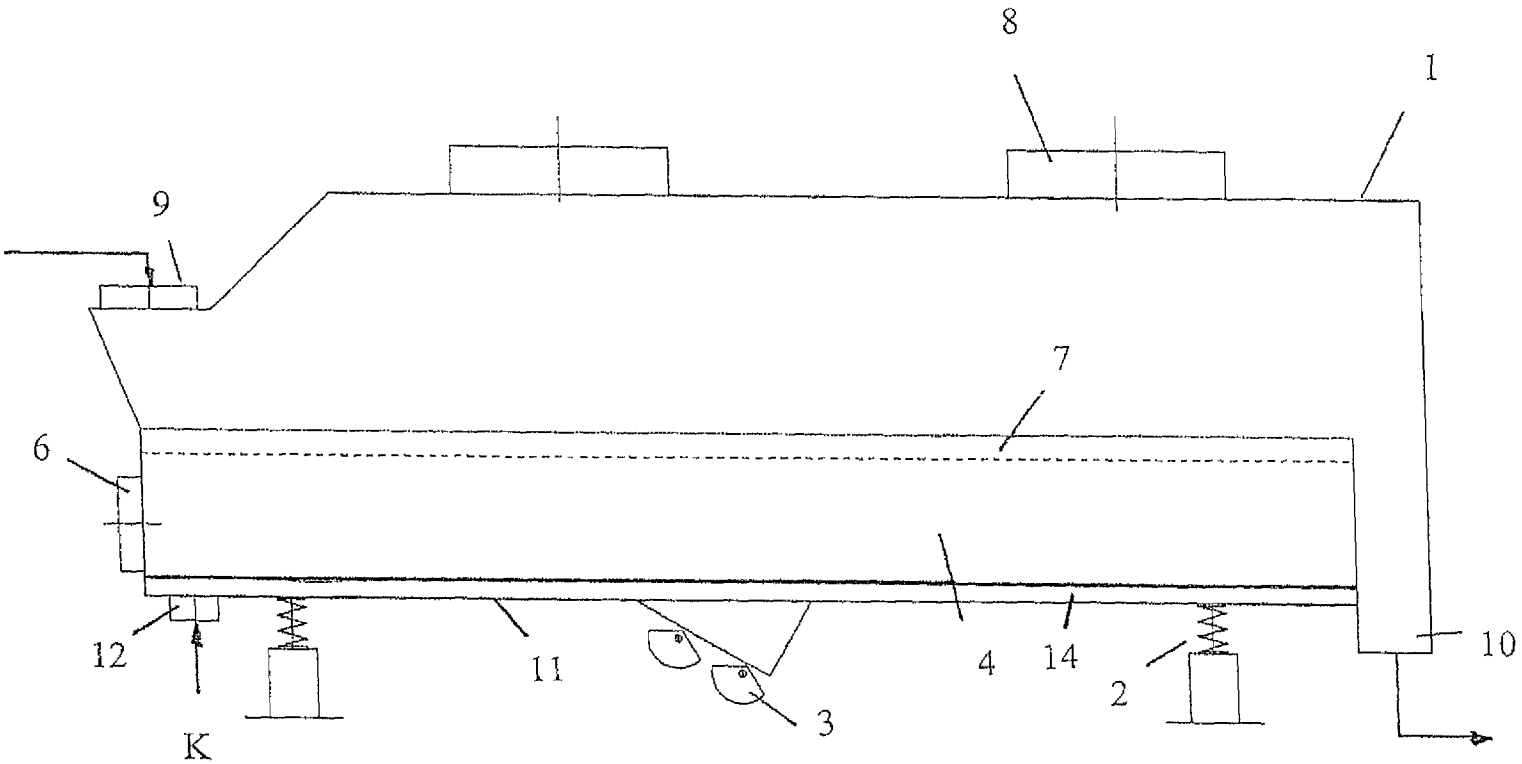

| | | | | |
|---|---|---|---|---|
| 3,605,275 | A | 9/1971 | Enders | |
| 3,731,393 | A * | 5/1973 | Okada et al. | 34/369 |
| 4,306,359 | A | 12/1981 | Hoyt | |
| 4,395,830 | A * | 8/1983 | Lockwood | 34/365 |
| 4,430,195 | A * | 2/1984 | Oltrogge | 208/410 |
| 4,473,033 | A * | 9/1984 | Strohmeyer, Jr. | 122/4 D |
| 6,000,644 | A | 12/1999 | Musschoot | |
| 8,281,861 | B2 * | 10/2012 | Nguyen et al. | 166/302 |
| 2011/0091955 | A1 * | 4/2011 | Constantz et al. | 435/168 |
| 2011/0158887 | A1 * | 6/2011 | Stoddard et al. | 423/348 |
| 2011/0257788 | A1 * | 10/2011 | Wiemers et al. | 700/267 |
| 2013/0047458 | A1 * | 2/2013 | Bero et al. | 34/370 |

FOREIGN PATENT DOCUMENTS

| | | | |
|---|---|---|---|
| DE | 26 08 228 | A1 | 9/1976 |
| DE | 34 00 399 | A1 | 11/1984 |
| EP | 0 570 218 | A1 | 11/1993 |
| GB | 657207 | | 9/1951 |
| WO | WO 2009/115564 | A1 | 9/2009 |

* cited by examiner

DRYER FOR MATERIAL TO BE DRIED

CROSS-REFERENCE TO RELATED APPLICATIONS

This is a National Phase application claiming priority to PCT/EP2009/053228 filed Mar. 19, 2009 which claims priority to AT GM 169/2008 filed Mar. 19, 2008, all of which are herein incorporated by reference in their entireties.

SCOPE OF THE INVENTION

The invention relates to a dryer for material to be dried comprising a feeding point for the material to be dried, a drying region, as well as a delivery point for the material to be dried, wherein an air supply channel for supplying a drying gas, preferably drying air, to the drying region is provided, as well as at least one exhaust-gas opening is provided for removing the drying gas after passing through the drying region, wherein the air supply channel is surrounded at least in sections at a distance by an outer wall, which has at least one supply opening for supplying a cooling medium as well as at least one removal opening for the cooling medium, wherein between the at least one supply opening and the at least one removal opening a flow section for the cooling medium is formed between the outer wall and the air supply channel.

STATE OF THE ART

Dryers of this type are used in the minerals industry, for example, where materials to be dried are dried by hot drying air at temperatures of several hundred degrees. The dryers can be designed differently thereby, for instance as drum, conveyor, stationary fluid bed, vibrating fluid bed or disc dryers. In the case of vibrating fluid bed dryers, for example, the material to be dried is transported via an inflow floor housed in a casing. In this case, the casing is vibrated through spring assemblies and a relevant vibration drive. Drying air heated by means of a hot gas generator is supplied to the dryer through an air supply channel. Generally, the air supply channel is located thereby in the lower regions of the dryer and the exhaust-gas opening in the upper regions of the dryer, so that the drying air flows through the inflow floor and the material to be dried that is transported on top on its way from the air supply channel to the exhaust-gas openings, and dries the material to be dried in the process.

As the air supply channel arranged inside the casing is heated up heavily due to the supply of the hot drying air, the supporting elements of the casing requiring protection are surrounded by an internal insulation, mainly of rock or mineral wool. At the same time, the air supply channel is designed as a screwed inner trough made of heat-resistant steel plates. However, this has the disadvantage that the inner trough is subjected to particularly high thermal expansion under the prevailing interior temperatures and strongly distorts thereby with an advanced operating period, and can even break at individual points. On top of that, fastening screws of the inner trough can work loose or can no longer be removed non-destructively after a certain operating period due to the high temperatures. Furthermore, the built-in internal insulation in vibrating dryer types is destroyed gradually due to the vibrating stress, looses its insulating effect with an advanced operating period and must be replaced. Lastly, these dryer types cannot be cleaned inside using water, as the insulating layer would get soaked with water and this would have an extremely negative impact on the vibration behavior and the insulating effect.

DE 26 08 228 A1 discloses an oven for baking ceramic tiles. The oven comprises a tunnel for acceptance of the objects to be baked, as well as a lower box that is arranged underneath, supplied with hot gases. The pressurized hot gases are driven into the tunnel from the lower box through a porous floor, as a result of which the objects to be baked are lifted from the floor and brought into a floating position. An outer wall is provided, which surrounds both the tunnel as well as the lower box. The lower box is thus surrounded by the outer wall, whereby a coolant, e.g. air, circulates between the inner wall and the outer wall.

The cooling air flow enters the floor laterally, is guided through horizontally arranged channels inside the floor, then exits through the upper side of the floor and rises up in the direction of the tunnel holding the material to be baked.

The system according to DE 26 08 228 A1 is a system with a closed cycle. The cooling air supplied to the system by means of a fan and mixed with the hot gas is aspirated through a circulation channel arranged in the ceiling region of the tunnel and transported into the lower box again. The provision of a circulating device, e.g. an ejector or an injector, is required for this purpose.

The (cooling air) region between the outer and the inner wall is connected with the lower box 3 by a tubular circulation channel.

AT 384 349 B discloses a drying system, wherein the drying chamber or its baffle plates are fitted with cooling elements, through which cooling fluid circulates.

The objective of the invention is to avoid the disadvantages of known drying systems and to realize a dryer that ensures sufficient cooling of the air supply channel for the drying air without the use of any insulating material. The aim thereby is to avoid excessive thermal expansions of the air supply channel and thus reduce the stress on the material. Moreover, it is aimed to reduce the maintenance effort by being able to prevent the replacement of the insulating material. Due to an improved cooling of the air supply channel and a lower rise in temperature of the supporting elements of the casing, it is also aimed to achieve an increase in the carrying capacity. Lastly, it is aimed to enable cleaning with water, which should facilitate the operation of a dryer according to the invention.

DISCLOSURE OF THE INVENTION

Said objectives are realized by the features of the claims. The invention relates to a dryer for material to be dried comprising a feeding point for the material to be dried, a drying region, as well as a delivery point for the material to be dried, wherein an air supply channel for supplying a drying gas, preferably drying air, to the drying region is provided, as well as at least one exhaust-gas opening is provided for removing the drying gas after passing through the drying region, wherein the air supply channel is surrounded at least in sections at a distance by an outer wall, which has at least one supply opening for supplying a cooling medium as well as at least one removal opening for the cooling medium, wherein between the at least one supply opening and the at least one removal opening a flow section for the cooling medium is formed between the outer wall and the air supply channel. According to the invention, it is provided in this case that the at least one removal opening is configured as a through-opening in the air supply channel, which connects the region bounded by the outer wall to the interior of the air supply channel, wherein the at least one through-opening is arranged in the upper regions of the air supply channel and is configured in such a way as to make it possible for the cooling medium to flow downwards along the inner side of the air supply channel.

The cooling air thus flows downwards along the inner walls of the air supply channel after entering into the air supply channel and thereby forms a "cold air curtain" between the hot drying air and the inner wall of the air supply channel, which results in particularly effective cooling of the air supply channel.

Consequently, a cooling medium flows through the air supply channel in an effective manner and causes the air supply channel to be cooled in this way instead of preventing a heat transfer to the elements of the casing through the use of insulation material. In addition, excessive thermal expansions are prevented by the cooling of the air supply channel, so that material stressing can be neglected. On top of that, the dryer can also be designed shorter, as it is possible to increase the drying air temperature due to the improved cooling.

In order to promote the formation of a cold air curtain, baffle plates for the cooling gas can be arranged in the region of the through-openings.

According to an advantageous further development of the invention, the cooling medium can be a cooling gas, and at least one removal opening is configured as a through-opening in the air supply channel, which connects the region bounded by the outer wall to the interior of the air supply channel. Said cooling gas is thereby preferably cooling air. The cooling air is guided into the interior of the air supply channel by means of the through-openings, where it does not cause any reduction in the temperature of the drying air worth mentioning however.

According to an advantageous further development of the invention, it is possible to provide that at least one removal opening is directed towards the area of the drying region facing the delivery point. The material to be dried is already relatively hot in these areas, so that the low temperatures of the cooling air suffice to remove any residual moisture in the material to be dried. The cooling medium thus also fulfils the function of secondary drying in addition to its cooling function.

What is more, the invention is particularly advantageous, if the dryer is a fluid bed dryer, in particular a vibrating fluid bed dryer.

In a special design variant, the at least one supply opening is arranged below the air supply channel.

SHORT DESCRIPTION OF FIGURES

In the following, the invention is explained in more detail based on possible embodiments that are shown in the figures enclosed. Shown are thereby in FIG. 1 a schematic side view of an embodiment of a dryer according to the invention, FIG. 2 the embodiment of a dryer according to the invention in accordance with FIG. 1 seen from the left side of FIG. 1, FIG. 3 a detailed section for illustration of the through-openings in the air supply channel, FIG. 4 schematics for a possible drying system using a dryer according to the invention, and in FIG. 5 an alternative embodiment in comparison with FIG. 1, wherein the removal opening is directed towards the area of the drying region facing the delivery point, and the cooling medium thus also fulfils the function of secondary drying.

METHODS FOR IMPLEMENTATION OF THE INVENTION

Figure 2:
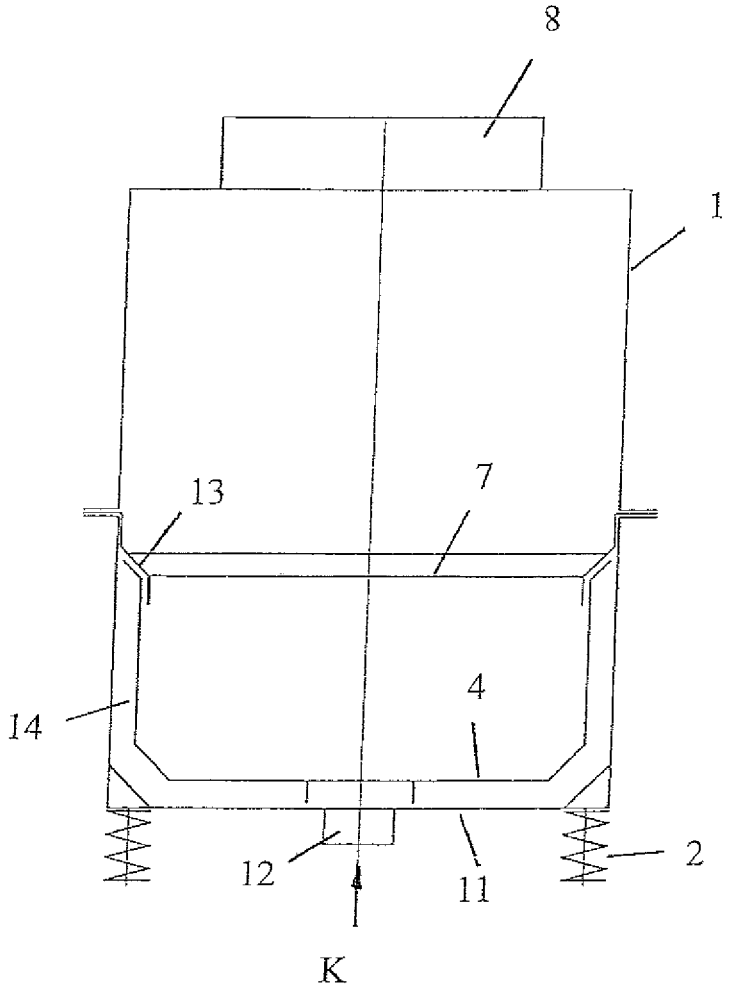

FIG. 1 shows an embodiment of a dryer according to the invention based on a vibrating fluid bed dryer comprising a casing 1, which is vibrated through spring assemblies 2 and a relevant vibration drive 3. Said dryer is provided with a feeding point 9 for the material to be dried T as well as a delivery point 10 for the material to be dried T, wherein the material to be dried T passes through a drying region between the feeding point 9 and the delivery point 10.

Furthermore, drying air that was heated by means of a hot gas generator 5 (see FIG. 4) is supplied to the dryer through the air supply opening 6 of an air supply channel 4. Generally, the air supply channel 4 is located thereby in the lower regions of the dryer, and is bounded towards the top by an inflow floor 7, such as a perforated floor plate, on which the material to be dried T is transported. The air supply channel 4 is also often designated as "inner trough" due to its trough-shaped design, and is connected firmly with the casing 1 (see also FIG. 3). The exhaust-gas openings 8 for removal of the drying gas are generally located in the upper regions of the dryer, so that the drying air flows through the inflow floor 7 and the material to be dried T that is transported on top on its way from the air supply channel 4 to the exhaust-gas openings 8, and dries the material to be dried T in the process.

The air supply channel 4 is surrounded at least in sections at a distance by an outer wall 11 (see also FIG. 2), which is provided with at least one supply opening 12 for supplying a cooling medium K as well as at least one removal opening 13 for the cooling medium K, wherein between the at least one supply opening 12 and the at least one removal opening 13 a flow section 14 for the cooling medium K is formed between the outer wall 11 and the air supply channel 4. Thereby, the at least one removal opening 13 is formed by through-openings in the air supply channel 4 between the region bounded by the outer wall 11 and the air supply channel 4. The cooling medium K is cooling air, for example, which will generally have room temperature.

According to the invention, it is provided that the at least one removal opening 13 is configured as a through-opening in the air supply channel 4, which connects the region bounded by the outer wall 11 to the interior of the air supply channel 4, wherein the at least one through-opening 13 is arranged in the upper regions of the air supply channel 4 and is configured in such a way as to make it possible for the cooling medium K to flow downwards along the inner side of the air supply channel 4.

Figure 3:
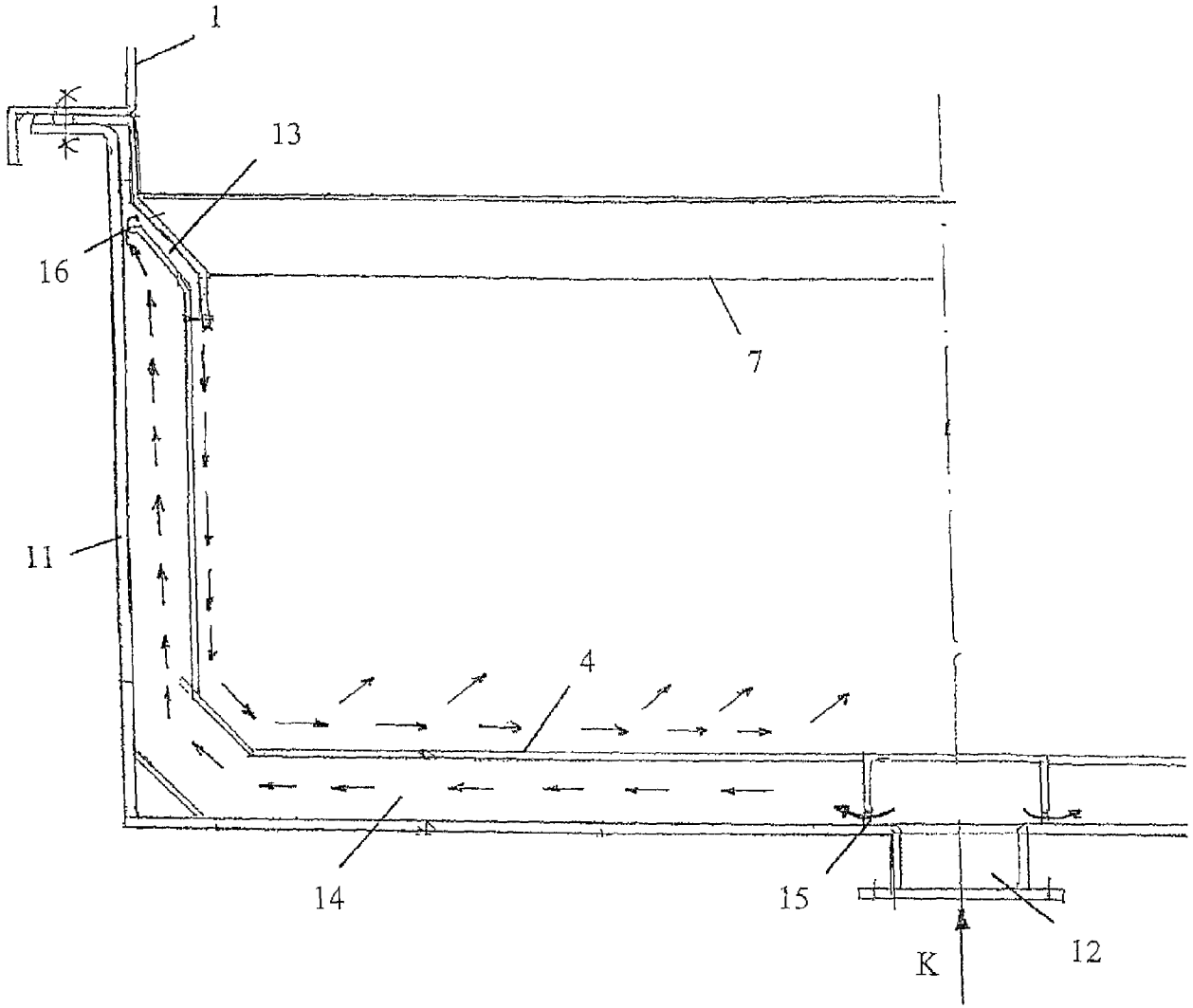

As can be seen in FIG. 3, the cooling air K flows downwards along the inner side of the air supply channel 4, whereby baffle plates can also be provided for this purpose, which promote the formation of a beneficial flow sequence. Based on such a design of the removal opening 13, a cold air curtain is formed, which protects the inner side of the air supply channel 4 effectively from excessive heat load.

This way, it is possible to prevent strong heating up of the air supply channel 4, and thus also high thermal expansion of the steel plates of the air supply channel 4. Subsequently, the cooling air K mixes with the drying air inside the air supply channel 4, but causes only a minor reduction of its temperature. Ultimately, the cooling air K escapes together with the drying air through the inflow floor 7.

As can be seen in FIG. 3, throttles 15 can be provided in the vicinity of the supply opening 12, which are formed, for example, by openings in spacing rails running along the longitudinal direction of the dryer. The throttles 15 promote an equal flow of the cooling air K along the flow section 14 to the removal openings 13. Throttles 16 can also be provided in the removal openings 13.

Figure 4:
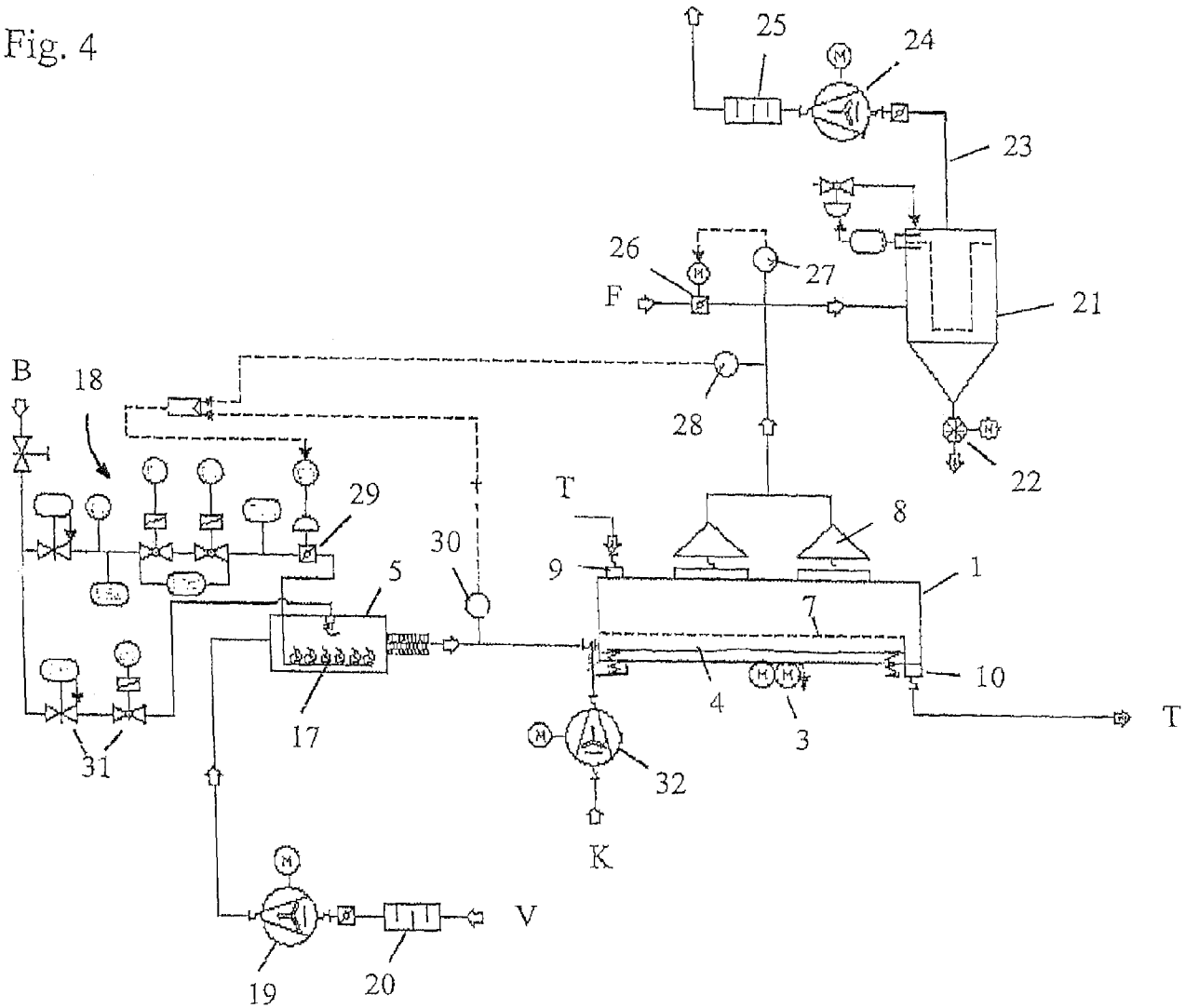

FIG. 4, finally, shows an embodiment of a possible drying system for material to be dried T using a dryer according to the invention, which is located in the picture center in FIG. 4. The dryer is fed with a material to be dried T, such as calcium carbonate, through the feeding point 9, said material to be dried exiting the dryer again through the delivery point 10. In addition, drying air that was heated by means of a hot gas generator 5 is supplied to the dryer. Said hot gas generator 5 comprises a burner 17 for this purpose, which is supplied with fuel B, preferably gas or oil. The fuel supply can be regulated thereby via a control unit 18. The hot gas generator 5 furthermore comprises an ignition gas unit 31. Combustion air V is supplied to the hot gas generator 5 using a first fan 19. Optionally, a sound absorber 20 can be provided in this case.

Figure 5:
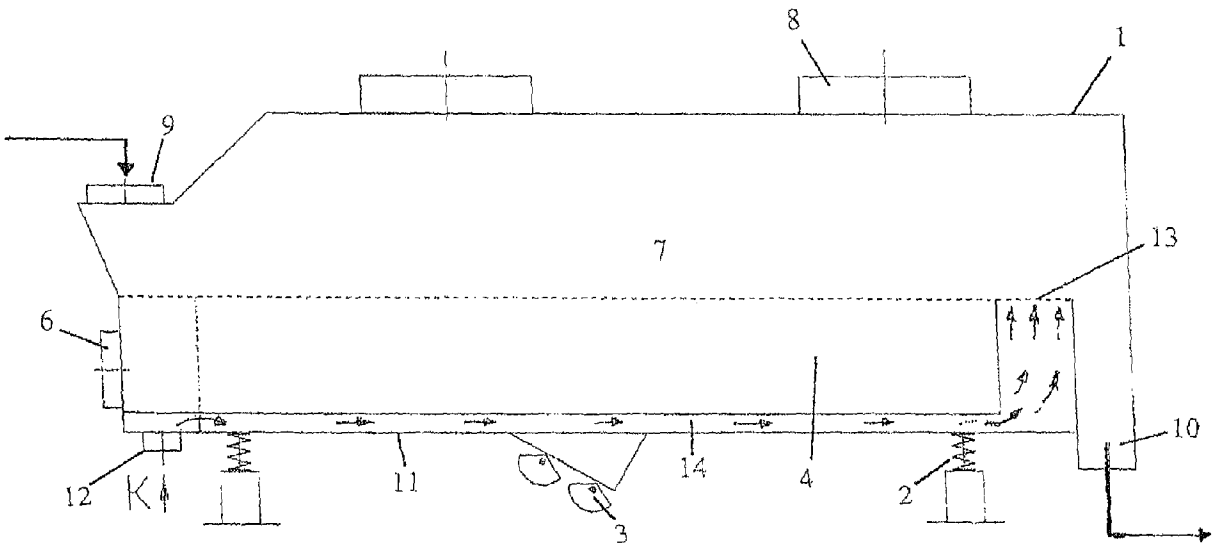

FIG. 5 furthermore shows an alternative embodiment in comparison with FIG. 1, wherein the removal opening 13 is directed towards the area of the drying region facing the delivery point 10. The material to be dried is already relatively hot in these areas, so that the low temperatures of the cooling air suffice to remove any residual moisture in the material to be dried. The cooling medium thus also fulfils the function of secondary drying in addition to its cooling function.

The drying air is supplied to the air supply channel 4 in the lower regions of the dryer, and removed through exhaust-gas openings 8 which are located in the upper region of the dryer. On its way from the air supply channel 4 to the exhaust-gas openings 8, it thereby flows through the inflow floor 7 and the material to be dried T transported on top. Subsequently, the drying air is supplied to a filter and/or separator 21, which separates portions of the material to be dried T that are carried along with the drying air. These portions can be removed through an outlet 22. The filtered drying air exits the separator 21 through the line 23, passes a second fan 24, and is released as exhaust air through a sound absorber 25. Fresh air F can be added to the drying air before entry into the separator 21, in order to control the temperature of the drying air. A quantity governor 26 can be provided for this purpose, which is regulated through a temperature sensor 27. Another sensor 28 monitors the drying air after passing the dryer and regulates the control unit 18 for the fuel through a quantity governor 29. Furthermore, the quantity governor 29 is regulated through another sensor 30, which monitors the temperature of the drying air before entry into the dryer.

Another fan 32 is provided for the cooling of the air supply channel 4 provided according to the invention, which aspirates fresh air as a cooling medium K and supplies it to the air supply channel 4 through the supply opening 12 (not shown in FIG. 4). In this case, the cooling air K has roughly room temperature.

Using the invention, a dryer is thus realized that ensures effective cooling of the air supply channel 4 without the use of any insulating material. Thereby, excessive thermal expansions of the air supply channel 4 can be avoided and thus the stress on the material reduced. Moreover, the maintenance effort can be reduced, as it is possible to prevent the replacement of the insulating material or the air supply channel 4. Due to an improved cooling of the air supply channel 4 and a lower rise in temperature of the supporting elements of the casing, it is furthermore also possible to achieve an increase in the carrying capacity. Finally, cleaning with water is possible, which additionally facilitates the operation of the dryer according to the invention.

The invention claimed is:

1. A dryer for material to be dried (T) comprising a feeding point (9) for the material to be dried, a drying region, as well as a delivery point (10) for the material to be dried (T), wherein an air supply channel (4) for supplying a drying gas to the drying region is provided, as well as at least one exhaust-gas opening (8) is provided for removing the drying gas after passing through the drying region, wherein the air supply channel (4) is surrounded at least in sections at a distance by an outer wall (11), which has at least one supply opening (12) for supplying a cooling medium (K) as well as at least one removal opening (13) for the cooling medium (K), wherein between the at least one supply opening (12) and the at least one removal opening (13) a flow section (14) for the cooling medium (K) is formed between the outer wall (11) and the air supply channel (4), and the at least one removal opening (13) is configured as a through-opening in the air supply channel (4), which connects the region bounded by the outer wall (11) to the interior of the air supply channel (4), wherein the at least one through-opening (13) is arranged in the upper regions of the air supply Channel (4) and is configured in such a way as to make it possible for the cooling medium (K) to flow downwards along the inner side of the air supply channel (4).

2. The dryer according to claim 1, further comprising baffle plates for the cooling gas are arranged in the region of the through-opening (13).

3. The dryer according to claim 1 wherein at least one removal opening (13) is directed towards the area of the drying region facing the delivery point (10).

4. The dryer according to claim 1 wherein the dryer is a fluid bed dryer.

5. The dryer according to claim 4, wherein the fluid bed dryer is a vibrating fluid bed dryer.

6. The dryer according to claim 1 wherein the cooling medium (K) is a cooling gas.

7. The dryer according to claim 1 wherein the at least one supply opening (12) dryer is arranged below the air supply channel (4).

* * * * *